US009945364B2

(12) United States Patent
Steffen et al.

(10) Patent No.: US 9,945,364 B2
(45) Date of Patent: Apr. 17, 2018

(54) HYDRAULIC DISTRIBUTOR FOR PUMP

(71) Applicant: Caterpillar Inc., Peoria, IL (US)

(72) Inventors: Joshua W. Steffen, El Paso, IL (US); Dana R. Coldren, Secor, IL (US)

(73) Assignee: Caterpillar Inc., Peoria, IL (US)

( * ) Notice: Subject to any disclaimer, the term of this patent is extended or adjusted under 35 U.S.C. 154(b) by 350 days.

(21) Appl. No.: 14/798,058

(22) Filed: Jul. 13, 2015

(65) Prior Publication Data

US 2017/0016434 A1 Jan. 19, 2017

(51) Int. Cl.

| | |
|---|---|
| ***F04B 15/08*** | (2006.01) |
| ***F04B 9/113*** | (2006.01) |
| ***F04B 53/04*** | (2006.01) |
| ***F04B 9/117*** | (2006.01) |

(52) U.S. Cl.

CPC ..... *F04B 15/08* (2013.01); *F04B 9/113* (2013.01); *F04B 9/1172* (2013.01); *F04B 53/04* (2013.01); *F04B 2015/081* (2013.01)

(58) Field of Classification Search

CPC F04B 9/109; F04B 9/113; F04B 9/117; F04B 9/1172; F04B 9/1176; F04B 15/08; F04B 2015/08; F04B 53/04; F03C 1/007; F03C 1/0073; F03C 1/0076

USPC ..... 60/429; 91/235, 324, 503, 536

See application file for complete search history.

(56) References Cited

U.S. PATENT DOCUMENTS

| | | | | |
|---|---|---|---|---|
| 2,549,897 | A * | 4/1951 | Evrell | F15B 11/17 137/114 |
| 3,032,994 | A * | 5/1962 | Lindell | E02F 3/181 37/902 |
| 5,879,137 | A * | 3/1999 | Yie | F04B 1/124 137/624.13 |
| 6,460,349 | B1 | 10/2002 | Kawano et al. | |
| 6,647,934 | B2 | 11/2003 | Marsh et al. | |
| 7,114,341 | B2 | 10/2006 | Gao | |
| 2011/0094244 | A1 | 4/2011 | Xu | |
| 2014/0182559 | A1* | 7/2014 | Steffen | F02D 19/0647 123/478 |
| 2015/0001428 | A1 | 1/2015 | Xu et al. | |

FOREIGN PATENT DOCUMENTS

WO WO 2014078962 A1 * 5/2014 ..... F17C 5/007

* cited by examiner

*Primary Examiner* — Charles Freay
*Assistant Examiner* — Joseph Herrmann
(74) *Attorney, Agent, or Firm* — Leydig, Voit & Mayer, LTD.; John Wappel

(57) ABSTRACT

A pump has a pump body and at least first and second pumping elements, each pumping element including a piston defining a head-end and a rod-end. The pump receives a pressurized fluid at an inlet, and returns fluid through a drain outlet. A hydraulic distributor operates to fluidly connect the head end of an extending piston to the pressurized fluid, and the rod end of the extending piston to the drain outlet. The hydraulic distributor further connects the rod-end of a retracting piston to the drain outlet, and the rod-end of one or more retracting pistons to the drain or to a return pressure, which is lower than an extending pressure.

16 Claims, 7 Drawing Sheets

HYDRAULIC DISTRIBUTOR FOR PUMP

TECHNICAL FIELD

This patent disclosure relates generally to pumps and, more particularly, to cryogenic fuel pumps for mobile applications.

BACKGROUND

Many large mobile machines such as mining trucks, locomotives, marine applications and the like have recently begun using alternative fuels, alone or in conjunction with traditional fuels, to power their engines. For example, large displacement engines may use a gaseous fuel, alone or in combination with a traditional fuel such as diesel, to operate. Because of their relatively low densities, gaseous fuels, for example, natural gas or petroleum gas, are carried onboard vehicles in liquid form. These liquids, the most common including liquefied natural gas (LNG) or liquefied petroleum gas (LPG), can be cryogenically stored in insulated tanks on the vehicles, or may alternatively be stored at an elevated pressure, for example, a pressure between 30 and 300 psi in a pressurized vessel. In either case, the stored fuel can be pumped, evaporated, expanded, or otherwise placed in a gaseous form in metered amounts and provided to fuel the engine.

The pumps that are typically used to deliver the LNG to the engine of the machine include pistons, which deliver the LNG to the engine. For example, while LNG may be stored at a pressure of about 300 psi, CNG for use by the engine may be provided at about 20.7 MPa. Such piston pumps, which are sometimes also referred to as cryogenic pumps, will often include a single piston that is reciprocally mounted in a cylinder bore. The piston is moved back and forth in the cylinder to draw in and then compress the gas. Power to move the piston may be provided by different means, the most common being electrical, mechanical or hydraulic power.

One example of a cryogenic pump can be found in U.S. Pat. No. 7,293,418 (the '418 patent), which describes a cryogenic, single-element pump for use in a vehicle. The pump discharges into an accumulator that is located within the tank, and uses a single piston pump that is connected to a drive section via a piston rod. The drive section is disposed outside of the tank.

SUMMARY

The present disclosure is generally directed to a hydraulically driven cryogenic pump comprising multiple pumping elements. Each of the pumping elements is sequentially actuated by a hydraulic distributor.

The disclosure, therefore, describes, in one aspect, a pump. The pump includes a pump body, a first pumping element and a second pumping element. Each of the first and second pumping elements is independently actuatable to perform a pumping stroke that delivers a pumped amount of fluid at a pump discharge, and includes a piston slidably disposed to reciprocate within a cylinder and defining a head-end volume and a rod-end volume on either side of the piston within the pump body. A first head-end passage is formed in the pump body, is fluidly connected with the head-end volume of the piston of the first pumping element, and forms a first head-end opening. A second head-end passage is formed in the pump body, is fluidly connected with the head-end volume of the piston of the second pumping element, and forms a second head-end opening. A first rod-end passage is formed in the pump body, is fluidly connected with the rod-end volume of the piston of the first pumping element, and forms a first rod-end opening. A second rod-end passage is formed in the pump body, is fluidly connected with the rod-end volume of the piston of the second pumping element, and forms a second rod-end opening. A high-pressure fluid inlet is formed in the pump body and forms a high-pressure inlet opening, and a drain outlet is formed in the pump body and forms a drain opening. A rotor is rotatably disposed within the pump body and is fluidly exposed to the high-pressure inlet opening on a first side and to the drain opening on a second side. The rotor forms a radially extending passage that is fluidly open to the drain opening, and a fill opening extending through the rotor between the first side and the second side. The fill opening is surrounded by a seat that fluidly isolates the fill opening from the drain opening. As the rotor is rotating within the pump body, it assumes at least a first orientation and a second orientation with respect to the pump body. In the first orientation, the fill opening is aligned with the first head-end passage to place the first head-end passage in fluid communication with the high-pressure inlet opening, and the radially extending passage overlaps the first rod-end passage to place the first rod-end passage in fluid communication with the drain opening.

In another aspect, the disclosure describes a system for use with a pump having a plurality of pumping elements that are hydraulically activated, each of the plurality of pumping elements including, respectively, a piston having a head-end and a rod-end and operating to extend and retract within a bore, thus effecting a pumping stroke. The system includes a high-pressure pump, a low-pressure pump, and a tank arranged to supply fluid to the high-pressure pump and the low-pressure pump. The tank is configured to act as a drain for fluid returning to the tank. A hydraulic distributor has a plurality of valve elements, each of the plurality of valve elements corresponding to a particular one of the plurality of hydraulically activated pumping elements. Each valve element includes a high pressure port connected to an outlet of the high-pressure pump, a low pressure port connected to an outlet of the low-pressure pump, a drain port connected to the tank, a head-end port connected to the head-end of the piston, and a rod-end port connected to the rod-end of the piston. The hydraulic distributor is arranged to cause one of the plurality of pumping elements, an extending piston, to extend the piston while the remaining of the plurality of pumping elements are arranged to retract their pistons by: fluidly connecting a rod-end of the extending piston and head-ends of the retracting pistons with the drain port, fluidly connecting the head-end of the extending piston with the high pressure port, and fluidly connecting the rod-ends of the remaining pistons with the low pressure port.

In yet another aspect, the disclosure describes a system for use with a pump having a plurality of pumping elements that are hydraulically activated. Each of the plurality of pumping elements includes, respectively, a piston having a head-end and a rod-end and operating to extend and retract within a bore, each piston being biased towards its respective head end by a spring. The system includes a tank arranged to supply fluid to the pump, the tank configured to act as a drain for fluid returning to the tank, and a hydraulic distributor having a plurality of valve elements, each of the plurality of valve elements corresponding to a particular one of the plurality of hydraulically activated pumping elements. Each valve element includes a pressure port connected to an outlet of the pump, a drain port connected to the tank, a head-end port connected to the head-end of a respective piston, and a rod-end port connected to the rod-end of the respective piston. The hydraulic distributor is arranged to cause one of the plurality of pumping elements, an extending piston, to extend its piston while the remaining of the plurality of pumping elements are arranged to retract their pistons by: fluidly connecting a rod-end of the extending piston, and head-ends and the rod-ends of the retracting pistons with the drain port, and fluidly connecting the head-end of the extending piston with the pressure port.

DETAILED DESCRIPTION

The present disclosure is applicable to hydraulically actuated pumps for pumping a fluid such as cryogenically stored fuel for single-, dual- or multiple-fuel engines. In the disclosed, exemplary pump embodiments, a hydraulic distributor is used to sequentially activate multiple pumping elements of the pump.

Figure 1:
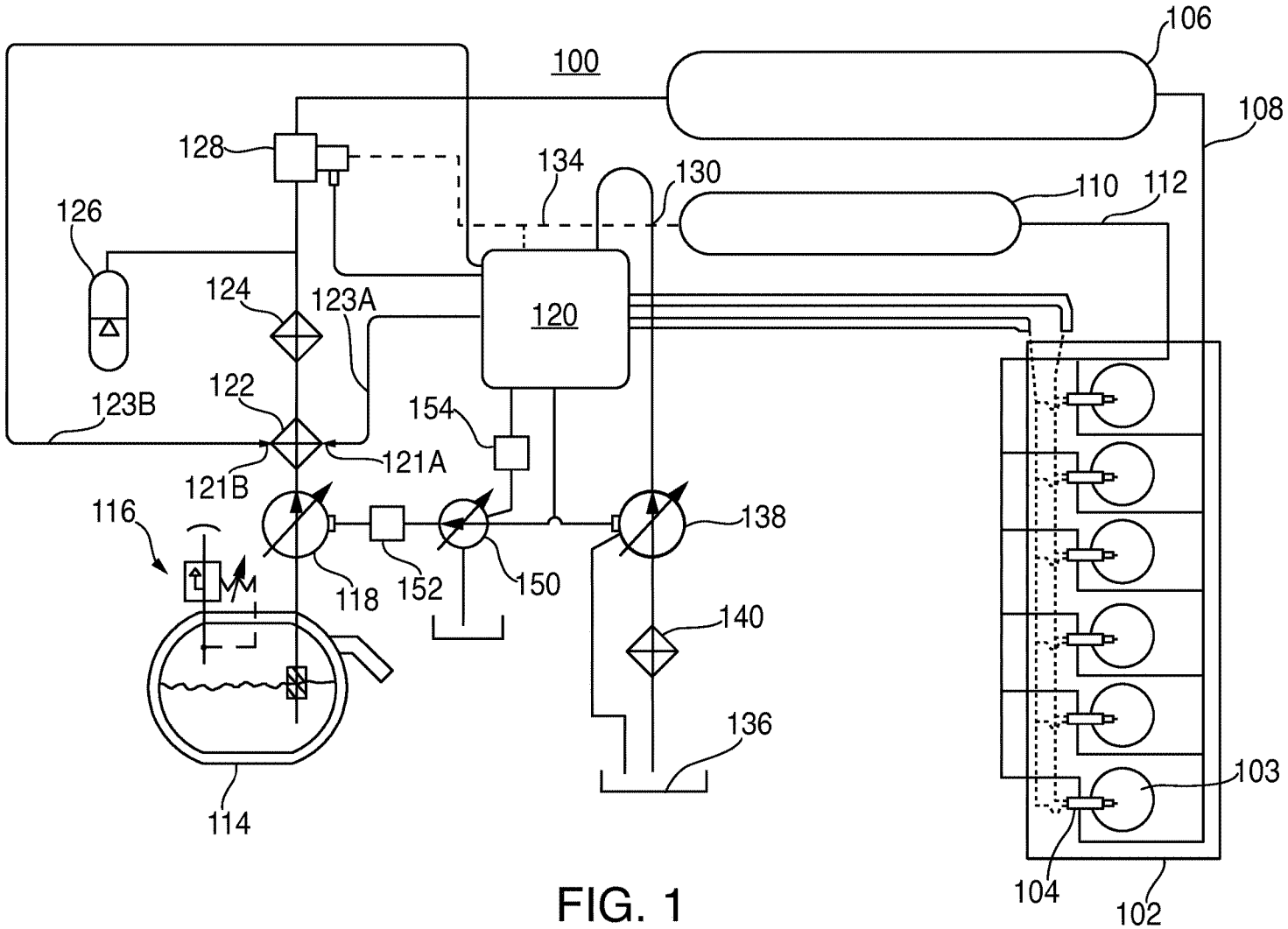
FIG. 1 is a block diagram of an engine system having a compressed gas fuel system that includes a gaseous fuel storage tank and corresponding fuel pump in accordance with the disclosure.

In one general aspect, the present disclosure relates to engines using a gaseous fuel source such as direct injection gas (DIG) or indirect injection gas engines using diesel or spark ignition. More particularly, the disclosure relates to an embodiment for an engine system that includes a gaseous fuel storage tank having a pump that supplies cryogenically stored fluid to fuel an engine. A block diagram of a DIG, engine system 100, which in the illustrated embodiment uses diesel as the ignition source, is shown in FIG. 1, but it should be appreciated that indirect injection engines, and/or engines using a different ignition mode are contemplated. The engine system 100 includes an engine 102 (shown generically in FIG. 1) having a fuel injector 104 associated with each engine cylinder 103. The fuel injector 104 can be a dual-check injector configured to independently inject predetermined amounts of two separate fuels, in this case, diesel and gas, into the engine cylinders.

The fuel injector 104 is connected to a high-pressure gaseous fuel rail 106 via a high-pressure gaseous fuel supply line 108 and to a high-pressure liquid fuel rail 110 via a liquid fuel supply line 112. In the illustrated embodiment, the gaseous fuel is natural or petroleum gas that is provided through the high-pressure gaseous fuel supply line 108 at a pressure of between about 10-50 MPa, and the liquid fuel is diesel, which is maintained within the high-pressure liquid fuel rail 110 at about 15-100 MPa, but any other pressures or types of fuels may be used depending on the operating conditions of each engine application. It is noted that although reference is made to the fuels present in the high-pressure gaseous fuel supply line 108 and the high-pressure liquid fuel rail 110 using the words "gaseous" or "liquid," these designations are not intended to limit the phase in which is fuel is present in the respective rail and are rather used solely for the sake of discussion of the illustrated embodiment. For example, the fuel provided at a controlled pressure within the high-pressure gaseous fuel supply line 108, depending on the pressure at which it is maintained, may be in a liquid, gaseous or supercritical phase. Additionally, the liquid fuel can be any hydrocarbon based fuel; for example DME (Di-methyl Ether), biofuel, MDO (Marine Diesel Oil), or HFO (Heavy Fuel Oil).

Whether the engine system 100 is installed in a mobile or a stationary application, each of which is contemplated, the gaseous fuel may be stored in a liquid state in a tank 114, which can be a cryogenic storage tank that is pressurized at a relatively low pressure, for example, atmospheric, or at a higher pressure. In the illustrated embodiment, the tank 114 is insulated to store liquefied natural gas (LNG) at a temperature of about −160° C. (−256° F.) and a pressure that is between about 100 and 1750 kPa, but other storage conditions may be used. The tank 114 further includes a pressure relief valve 116 and a fill port 144. The fill port 144 may include special or appropriate features for interfacing with a compressed natural gas (CNG) and/or liquid petroleum gas (LPG) fill hose or valve. In the description that follows, a DIG engine system embodiment is used for illustration, but it should be appreciated that the systems and methods disclosed herein are applicable to any machine, vehicle or application that uses cryogenically stored gas, for example, a locomotive in which the tank 114 may be carried in a tender car.

Relative to the particular embodiment illustrated, during operation, LNG from the tank is pressurized, still in a liquid phase, in a pump 118, which raises the pressure of the LNG while maintaining the LNG in a liquid phase. The pump 118 is configured to selectively increase the pressure of the LNG to a pressure that can vary in response to a pressure command signal provided to the pump 118 from an electronic controller 120. The pump 118 is shown external to the tank 114 in FIG. 1 for illustration, but it is contemplated that the pump 118 may at least partially be disposed within the tank 114. Although the LNG is present in a liquid state in the tank, the present disclosure will make reference to compressed or pressurized gas for simplicity when referring to gas that is present at a pressure that exceeds atmospheric pressure.

The pressurized LNG provided by the pump 118 is heated in a heat exchanger 122. The heat exchanger 122 provides heat to the compressed LNG to reduce density and viscosity while increasing its enthalpy and temperature. In one exemplary application, the LNG may enter the heat exchanger 122 at a temperature of about −160° C., a density of about 430 kg/m$^3$, an enthalpy of about 70 kJ/kg, and a viscosity of about 169 μPa s as a liquid, and exit the heat exchanger at a temperature of about 50° C., a density of about 220 kg/m$^3$, an enthalpy of about 760 kJ/kg, and a viscosity of about 28 μPa s. It should be appreciated that the values of such representative state parameters may be different depending on the particular composition of the fuel being used. In general, the fuel is expected to enter the heat exchanger in a cryogenic, liquid state, and exit the heat exchanger in a supercritical gas state, which is used herein to describe a state in which the fuel is gaseous but has a density that is between that of its vapor and liquid phases.

The heat exchanger 122 may be any known type of heat exchanger or heater for use with LNG. In the illustrated embodiment, the heat exchanger 122 is a jacket water heater that extracts heat from engine coolant. In alternative embodiments, the heat exchanger 122 may be embodied as an active heater, for example, a fuel fired or electrical heater, or may alternatively be a heat exchanger using a different heat source, such as heat recovered from exhaust gases of the engine 102, a different engine belonging to the same system such as what is commonly the case in locomotives, waste heat from an industrial process, and other types of heaters or heat exchangers such as ambient air fin or tube heat exchangers. In the embodiment shown in FIG. 1, which uses engine coolant as the heat source for the heat exchanger 122, a pair of temperature sensors 121A and 121B are disposed to measure the temperature of engine coolant entering and exiting the heat exchanger 122 and provide corresponding temperature signals 123 to the electronic controller 120.

Liquid fuel, or in the illustrated embodiment diesel fuel, is stored in a fuel reservoir 136. From there, fuel is drawn into a variable displacement pump 138 through a filter 140 and at a variable rate depending on the operating mode of the engine. The rate of fuel provided by the variable displacement pump 138 is controlled by the pump's variable displacement capability in response to a command signal from the electronic controller 120. Pressurized fuel from the variable displacement pump 138 is provided to the high-pressure liquid fuel rail 110. Similarly, the pump 118 has a variable supply capability that is responsive to a signal from the electronic controller 120.

Gas exiting the heat exchanger 122 is filtered at a filter 124. As can be appreciated, the gas passing through the filter 124 may include gas present in more than one phase such as gas or liquid. An optional gas accumulator 126 may collect filtered gas upstream of a pressure regulator 128 that can selectively control the pressure of gas provided to the high-pressure gaseous fuel rail 106 that is connected to the high-pressure gaseous fuel supply line 108. To operate the pump 118, a hydraulic pump 150 having a variable displacement and selectively providing pressurized hydraulic fluid to various pumping elements of the pump 118 via a hydraulic distributor 152 is used. Operation of the hydraulic pump 150 is controlled by an actuator 154 that responds to commands from the electronic controller 120.

Figure 2:
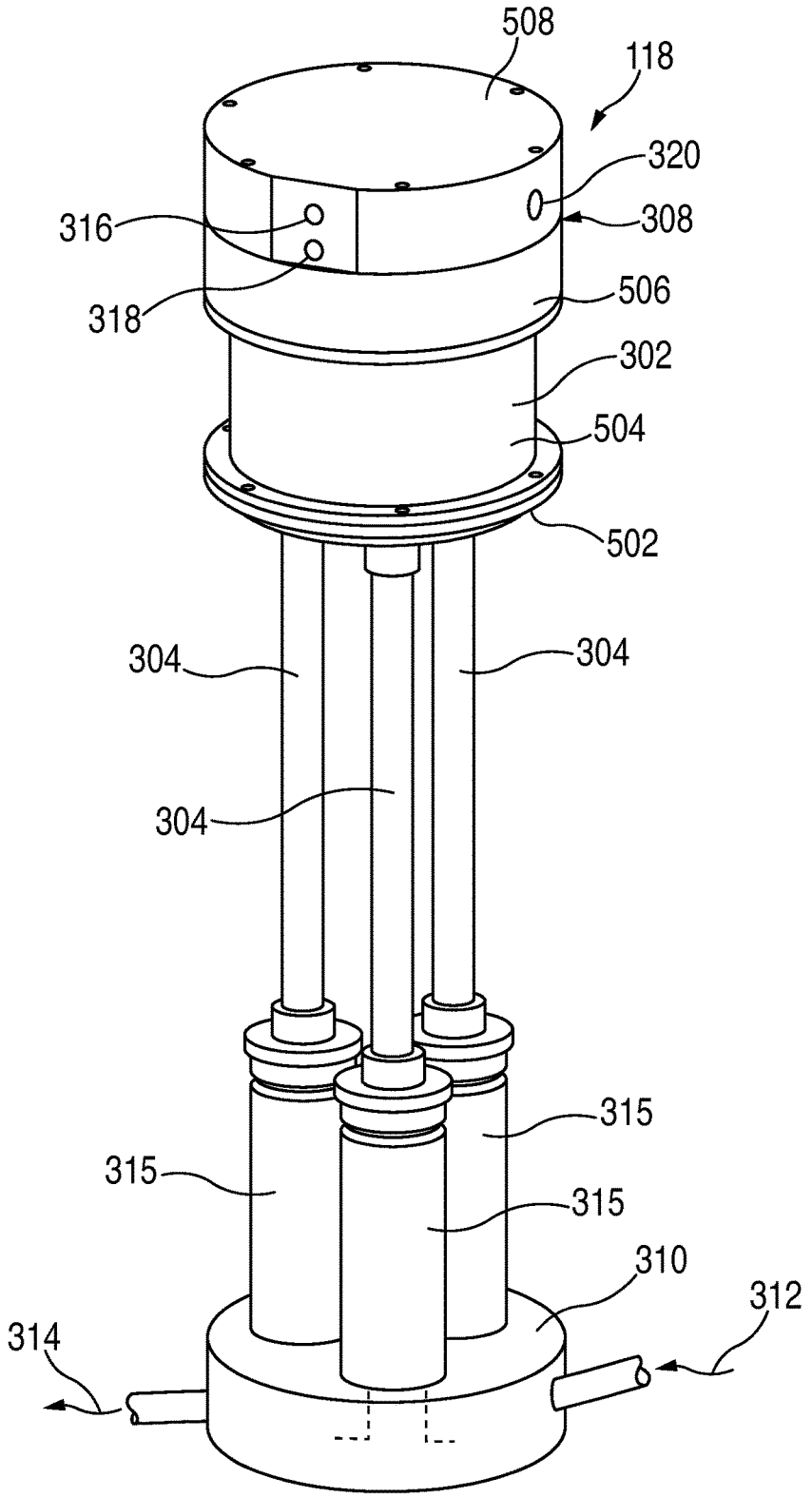
FIG. 2 is an outline view of a multi-element pump in accordance with the disclosure.

An outline view of the pump 118 is shown in FIG. 2. The pump 118 in the illustrated embodiment has a generally cylindrical shape and includes an actuation portion 302 that operates to selectively actuate one or more pushrods 304 (three shown). Each pushrod 304 is activated by a respective pump actuation element, which is described hereinafter. The pump actuation elements, in this case, three actuation elements, one corresponding to each pushrod 304, are sequentially activated by a hydraulic distributor 308. The pushrods 304, which are caused to reciprocate during operation by the actuation portion 302, extend from the actuation portion 302 to a pumping portion 310. The pumping portion 310, which includes a fluid inlet 312 and a pressurized fluid outlet 314, includes three plunger barrels 315, each containing a reciprocable plunger that is activated by the respective pushrod 304, as well as inlet and outlet check valves (not shown) that permit the pumping of fluid from the fluid inlet 312 to the pressurized fluid outlet 314. Relative to the illustrated embodiment, the hydraulic distributor 308 forms a high pressure fluid inlet 316, a low pressure fluid inlet 318, and a drain outlet 320. A schematic diagram illustrating operation of the hydraulic distributor 308 is shown in FIG. 3, where structures and elements that are the same or similar than corresponding structures and elements already described are denoted by the same reference numerals as previously used for sake of discussion.

Figure 3:
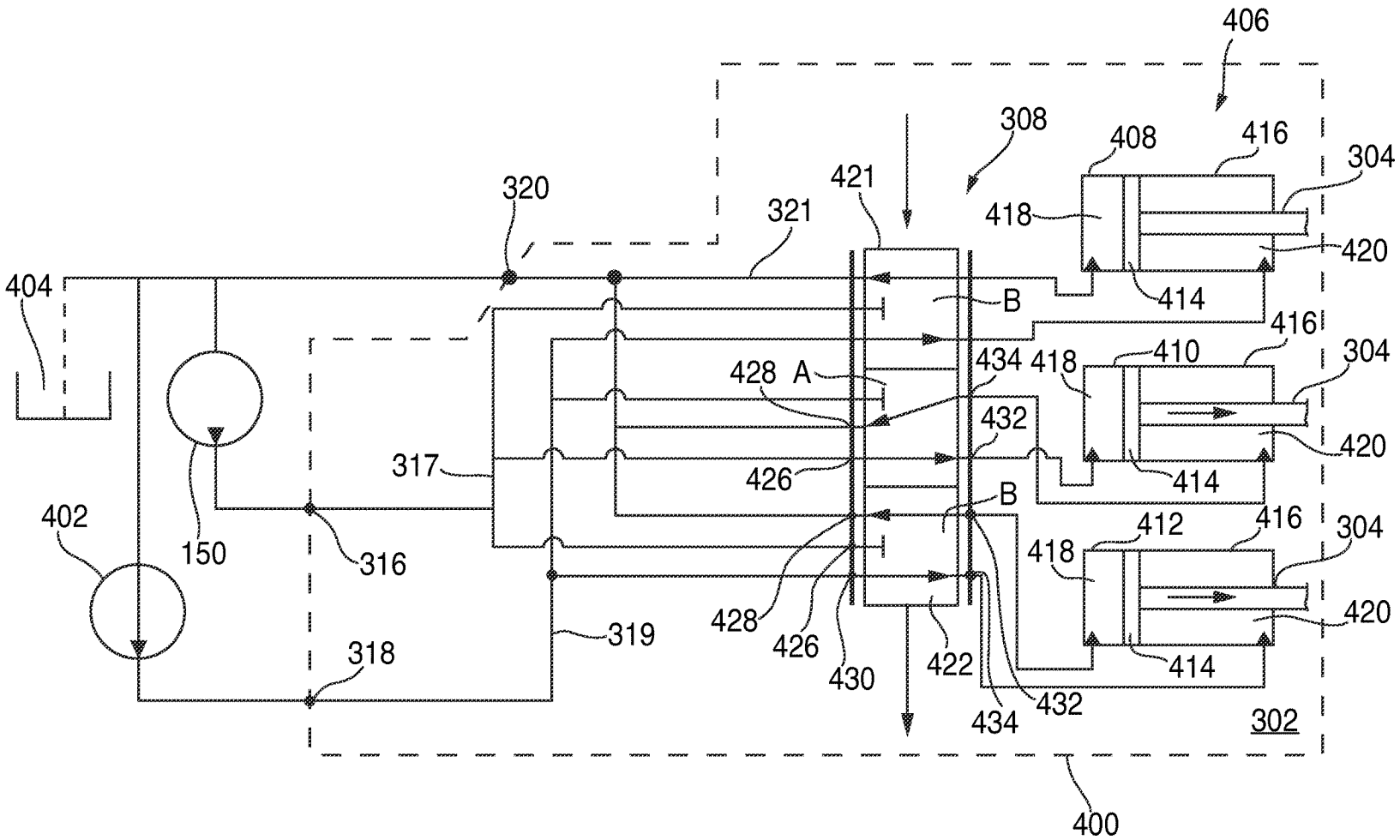
FIG. 3 is a schematic diagram of a first embodiment of a hydraulic distributor in accordance with the disclosure.

In reference to FIG. 3, a dashed line 400 encloses what has been referred to above as the actuation portion 302 in one exemplary embodiment, which includes the hydraulic distributor 308. In the illustrated embodiment, the hydraulic pump 150, which operates as a high pressure fluid pump, provides hydraulic fluid at a high pressure to the actuation portion 302 via the high pressure fluid inlet 316. The high pressure fluid inlet 316 is fluidly connected to a high pressure circuit 317. A low pressure fluid pump 402, supplies low pressure hydraulic fluid to the low pressure fluid inlet 318. The low pressure fluid inlet is fluidly connected to a low pressure fluid circuit 319. The "high" and "low" pressure designations in this context mean that the pressure at which fluid is provided from the low pressure fluid pump 402 is lower than the pressure at which fluid is provided from the hydraulic pump 150 or, stated differently, the pressure of fluid provided by the high pressure pump 150 is higher than a pressure at which fluid is provided by the low pressure fluid pump 402. The high and low pressure fluid pumps 150 and 402 draw oil from a sump 404, which also receives oil returning from the actuation portion 302 via the drain outlet 320. The drain outlet 320 is fluidly connected to a drain circuit 321. Various sensors, for example, oil temperature and/or pressure sensors can be incorporated or associated with the actuation portion 302 or other portions of the system, but have been omitted for simplicity.

High pressure oil from the high pressure pump 150, low pressure oil from the low pressure fluid pump 402, and oil draining from the actuation portion 302 into the sump 404 are selectively fluidly routed to and from corresponding ports in various hydraulic actuators 406 of the actuation portion 302. In the illustrated embodiment, three actuators including a first actuator 408, a second actuator 410 and a third actuator 412 are shown, but in alternative embodiments a single actuator, two actuators, or any odd or even number of more than three actuators can be used. Each of the first, second and third actuators 408, 410 and 412 includes a respective piston 414 that is slidably disposed in a cylinder 416 such that two closed and variable volumes, a first volume 418, which can also be referred to as the head-end volume, and a second volume 420, which can also be referred to as the rod-end volume, are formed within each cylinder on either side of the piston 414.

The actuation portion 302 includes the hydraulic distributor 308. One embodiment for the actuation portion 302 is schematically shown in FIG. 3 to include three valve elements 422 arranged onto a shuttle valve structure 421. Each of the three valve elements includes three inlets and two outlets. Specifically, each valve element includes a high pressure port 426, a low pressure port 430 and a drain port 428. Each valve element further includes a head-end port 432 and a rod-end port 434. While the three valve elements 422 are shown arranged in a row and sliding in two directions, it should be appreciated that, in one embodiment, the valve elements may be arranged in a rotor structure that sequentially cycles each valve element 422 past each actuator 406.

During operation, the various pump actuators 406 undergo an actuation stroke in which one, or more, of the actuators undergoes an extension stroke in which the respective first volume 418 or head-end volume is exposed to high oil pressure from the high pressure circuit 317 while the second volume 420 or rod-end volume is exposed to low pressure from the low pressure fluid circuit 319 or to the drain circuit 321. In this way, a pressure differential will be applied across the first and second volumes 418 and 420 tending to increase the volume of the first volume 418 (head end) and decrease the volume of the second volume 420 (rod end) tending to push against the pushrod 304. While the one (or more) actuators 406 is undergoing an extension stroke, the remaining actuators 406 may be undergoing a retraction stroke at a lower speed than the extension stroke by exposing the second volume 420 (rod end) to a high or low pressure and the first volume 418 (head end) to a lower pressure such as fluid at the low pressure or via the drain circuit 321. In the illustrated embodiment, retraction is accomplished by exposing the second volume 420 to low pressure from the low pressure fluid circuit 319 and connecting the first volume 418 to the drain circuit 321 such that a pressure differential tending to increase the volume of the second volume 420 and decrease the volume of the first volume 418 to retract the piston 414 towards the head end.

It should be appreciated that the retraction speed can be selected based on the application requirements and also on the number of actuators 406 present in the system. For example, in a pump having three actuators, one actuator may be undergoing an extension stroke while the remaining two actuators may be retracting, which provides sufficient time to retract the two retracting actuators at about half the speed of the extending actuator. In certain applications such as those pumping cryogenic fluids, a slower retraction stroke may be configured as a plunger fill stroke, which can lead to more efficient operation of the pump and less working fluid cavitation at a slower actuator refraction stroke.

The various fluid connections for the actuators 406 are provided by the valve elements 422. For example, a pumping-stroke valve element 422, denoted as "A" in FIG. 3, may fluidly connect, directly or through a flow orifice (not shown), the high pressure port 426 with the rod-end port, and the drain port 428 with the rod-end port to apply the greatest pressure difference available in the system across the piston 414, which causes the piston to extend. Similarly, the two remaining valve elements 422, which are filling-stroke elements and are denoted as "B" in FIG. 3, may fluidly connect the low pressure port 430 with the rod-end port 434 and the drain port 428 with the head-end port 432 to apply a less-than-full pressure differential across the piston 414, which causes the piston to retract at a slower speed.

Figure 4:
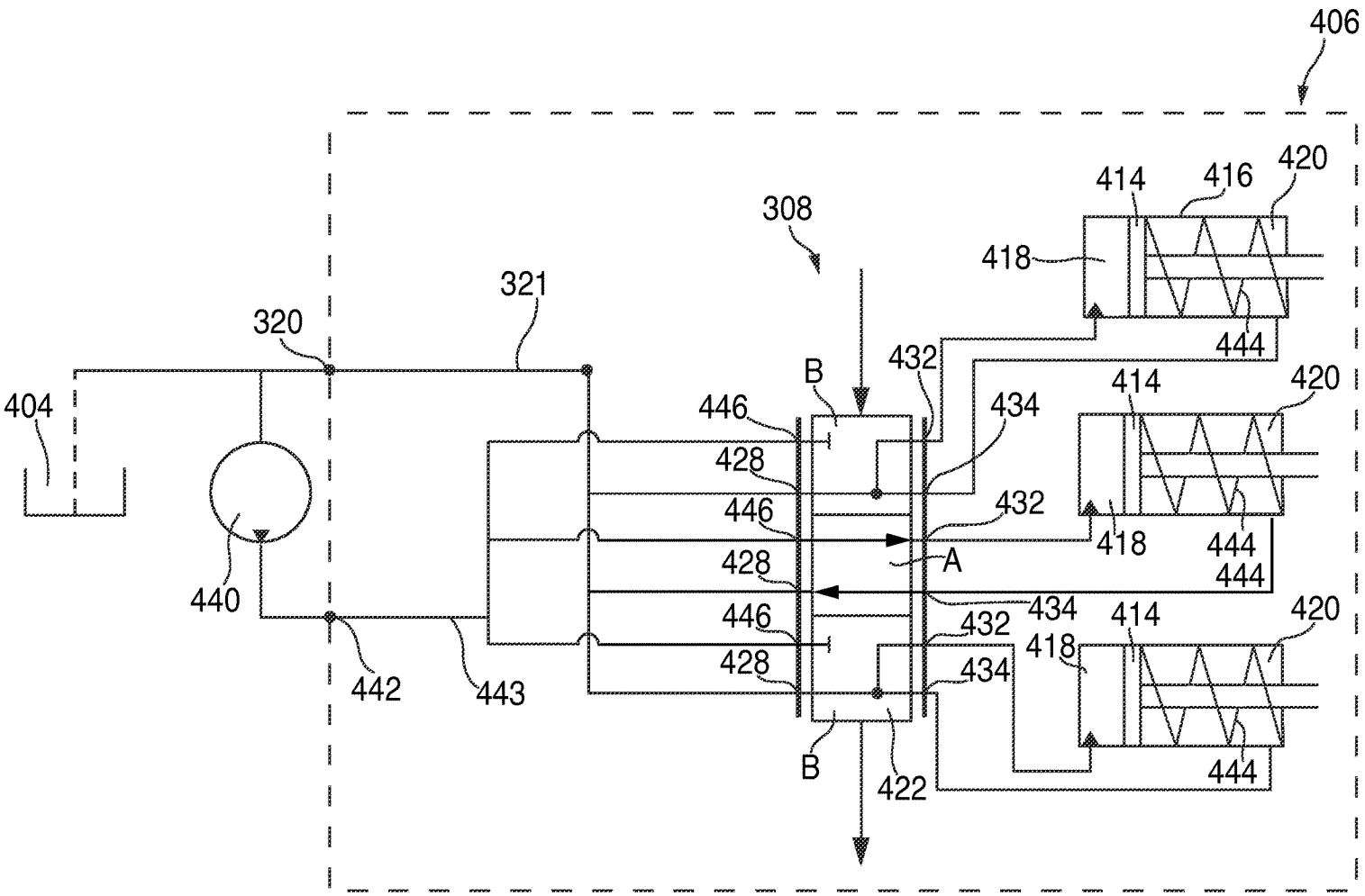
FIG. 4 is a schematic diagram of a second embodiment of a hydraulic distributor in accordance with the disclosure.

An alternative embodiment for an actuation portion 302 is schematically shown in FIG. 4. In this embodiment, where like or similar elements are denoted by the same reference numerals as previously used for simplicity, a single pump 440 supplies fluid from a sump 404 to the actuation portion 302 under pressure via a pressure inlet 442, which is connected to a pressure circuit 443. In this embodiment, each actuator 406 includes a return spring 444 that helps retract the piston 414 within its respective cylinder 416 in a fashion that does not require two different pressure levels but that also provides for a slower retraction speed for each actuator as compared to its extension speed.

More specifically, each of the valve elements 422 on the distributor includes a pressure port 446, which is connected to the pressure circuit 443, and a drain port 428 connected to the drain circuit 321. The pumping-stroke valve element 422, also denoted here as "A", fluidly connects the head-end port 432 with the pressure port 446, and the rod-end port 434 with the drain port 428 when extending the piston 414 within the cylinder 416. However, unlike the embodiment shown in FIG. 3, in the embodiment of FIG. 4, the filling-stroke valve elements 422, also denoted as "B", connect both the head-end port 432 and the rod-end port 434 together and also to the drain port 428 such that no net hydraulic forces are acting on the piston 414 and the return force is provided by the return spring 444. Accounting for friction and other parasitic losses, the spring parameters of the return spring 444 can be selected to provide a desired and/or sufficient retracting stroke speed. It should be noted that a hybrid approach may be taken, for example, the addition of a spring to assist with retraction in the actuators 406 shown in the embodiment of FIG. 3.

Figure 6:
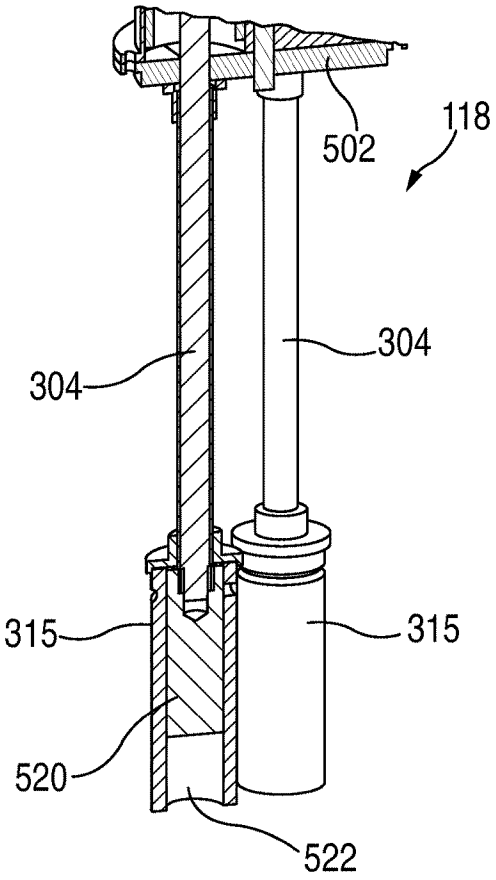
FIG. 6 is a cross section of a pumping portion of a cryogenic pump in accordance with the disclosure.
Figure 5:
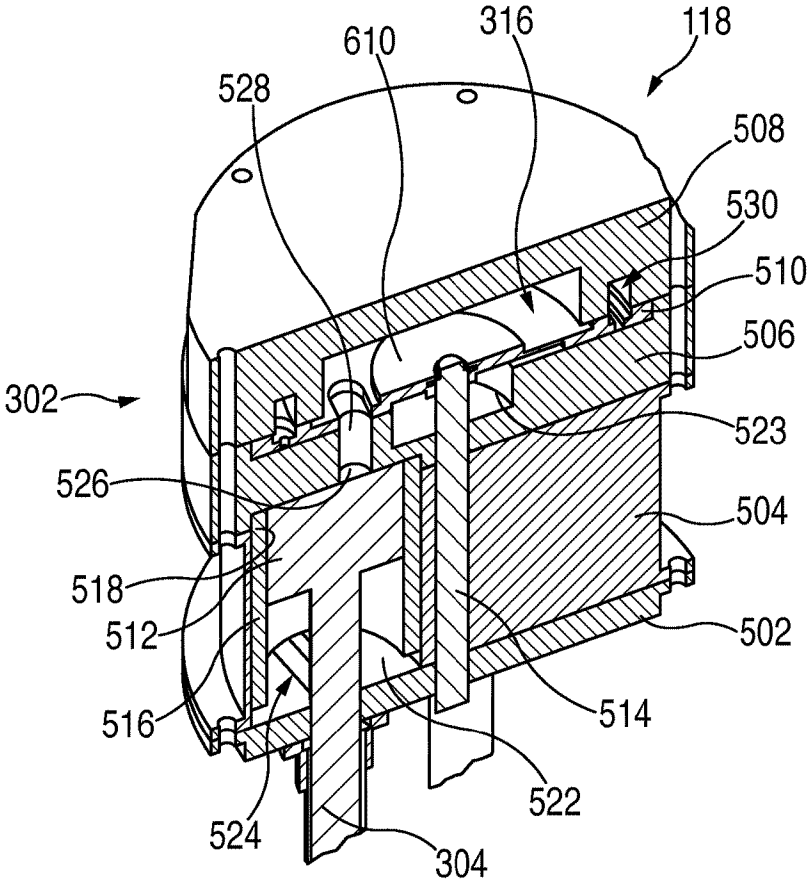
FIG. 5 is a cross section of an actuation portion of a cryogenic pump in accordance with the disclosure.

An embodiment for one exemplary implementation of the hydraulic distributor 308 for use in the pump 118 is shown in the cross sections of FIGS. 5 and 6, in which various structures of the pump 118 are denoted by the same reference numerals as used in FIG. 2. The actuation portion 302 is made from a bottom plate 502, a tappet housing 504, a flow plate 506, and a cover plate 508. A rotor 510 that forms various passages therein is rotatably disposed in a space formed axially between the flow plate 506 and the cover plate 508. As shown, the rotor 510 has a generally circular shape that is connected at its center to a shaft 514. The shaft 514 is connected at one end to the rotor 510 and rotatably extends through the flow plate 506, the tappet housing 504, and the bottom plate 502 such that a free end of the shaft 514 extends past the bottom plate 502 so it can be connected to a motor or other device effecting rotation of the rotor 510 via the shaft 514 at a selectively desired angular velocity, which may be constant or variable. While one possible configuration is shown, rotation of the rotor 510 can be accomplished by any other appropriate methods such as a motor integrated in the pump.

The various components form passages and openings to accommodate mounting of components therein and/or the flow of oil at different pressures through various conduits or passages. In the illustrated embodiment, a piston or tappet 512 is slidably disposed to reciprocate within a cylindrical liner 516 that is mounted in a bore 518 extending axially through the tappet housing 504. The tappet 512 is connected to, or at least abuts, an end of the pushrod 304 such that the reciprocal motion of the tappet 512 within the liner 516 is transferred to the pushrod 304. At an end opposite the tappet 512, as shown in FIG. 6, the pushrod 304 is connected to a plunger 520, which reciprocates within a variable volume 522 following the motion of the tappet 512 to carry out a pumping action.

The various passages formed between or within the plates 502, 506 and 508 fluidly connect various portions above and below the tappet 512 with the high pressure fluid inlet 316 (shown in FIG. 2), the low pressure fluid inlet 318 (also shown in FIG. 2), and the drain outlet 320 (also shown in FIG. 2) selectively during operation to effect motion of the tappet 512 under a hydraulic fluid pressure differential applied on either side of the tappet 512, which acts as a piston, as is generally described relative to the system shown in FIGS. 3 and 4. More specifically, a return volume 522 defined between the tappet 512 and the bottom plate 502 is fluidly connectable via a rod-end passage 524 to low pressure hydraulic fluid or to the drain. For illustration, the rod-end passage 524 operates like the passage connected to the rod-end port 434 (FIG. 3) of the hydraulic distributor 308. Similarly, an extend volume 526 defined on the head-end of the piston or tappet 415 between the tappet 512 and the flow plate 506, which pushes the tappet 512 away from the flow plate 506 when filling, is connected to a head-end passage 528 that is formed through and extends through the flow plate 506. The head-end passage 528 operates like the passage connected to the head-end port 432 (FIG. 3) of the hydraulic distributor 308 (FIG. 3). A low pressure passage 530 having a generally annular shape is defined between the rotor 510 and a channel formed in the underside of the cover plate 508. The low pressure passage 530 is fluidly connected to the low pressure fluid inlet 318 (FIG. 2).

Figure 7:
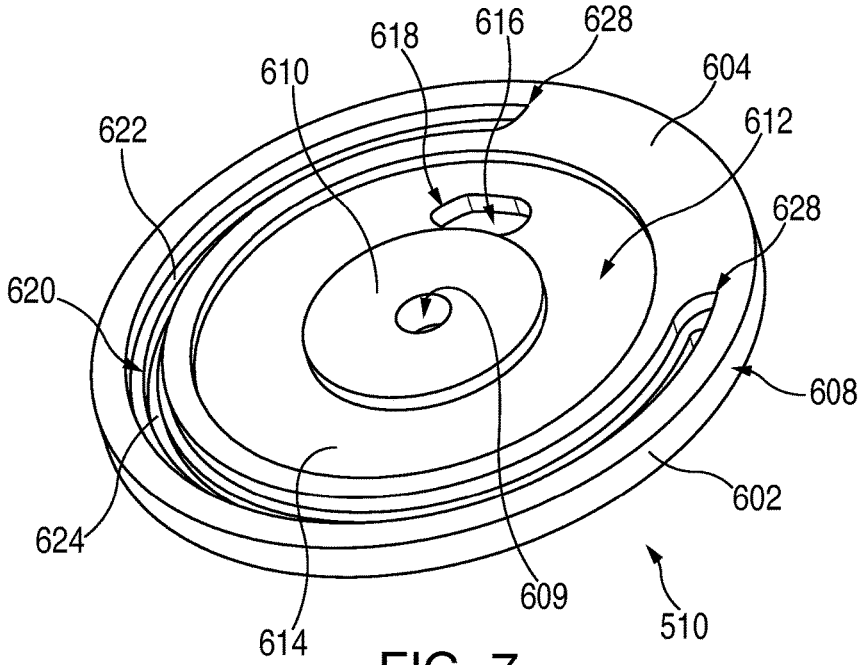
FIGS. 7 and 8 are two views of a rotor for a hydraulic distributor in accordance with the disclosure.
Figure 8:
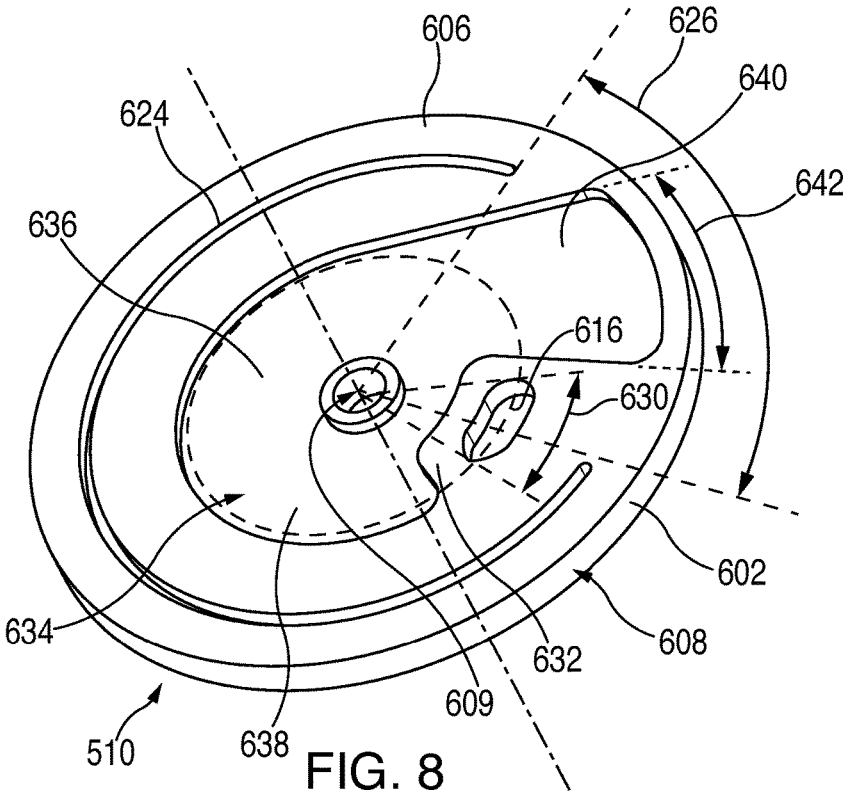

The various fluid interconnections between the head-end passage 528 and rod-end passage 524 with the high pressure fluid inlet 316, the low pressure fluid inlet 318, and the drain outlet 320 are selectively accomplished when various passages and features of the flow plate 506, the cover plate 508 and the bottom plate 502 are aligned with features on the rotor 510 as the rotor 510 rotates within the pump 118. Top and bottom views of the rotor 510 removed from the pump 118 are shown in FIGS. 7 and 8 for illustration of its various features. In reference to these figures, FIG. 7 shows the top of the rotor 510, which faces the cover plate 508 when installed in the pump 118, and FIG. 8 shows the bottom of the rotor 510, which faces the flow plate 506 when installed in the pump 118. Although "top" and "bottom" are used in this description, these designations are for sake of discussion and not indicative of an installation or operating orientation of the rotor 510 or the pump 118.

In reference now to FIGS. 7 and 8, the rotor 510 has a generally circular, plate-shaped body 602 having a planar, upper surface 604, a planar, bottom surface 606, and a peripheral surface 608. The upper surface 604 and bottom surface 606, in the illustrated embodiment, are arranged to slidably and sealably interact with corresponding faces of the pump body above and below the rotor. The upper surface 604 forms a central hub 610 that is surrounded by an annular depression 612. The central hub 610 is formed at the center of the body 602 and surrounds a drive opening 609, through which the rotor 510 can be attached to the shaft 514. A depth of the annular depression 612 relative to the upper surface 604 is less than a thickness of the body 602 such that a depressed, annular surface 614 is formed that extends peripherally around the central hub 610. The annular surface 614 forms a fill opening 616 that extends through the body 602 to create a fluid passage extending through the rotor 510. As shown, the fill opening 616 has a generally elliptical cross section that is curved to follow a curvature of the rotor 510 and that is notched at one end 618, which in a direction of rotation of the rotor 510 within the pump 118 is the leading end of the fill opening 616.

Surrounding the annular depression 612 for a portion of, but not necessarily the entire periphery 608, is a channel 620. The channel 620 includes a pair of ledges 622 disposed radially on either side of a slot 624. The ledges 622 are depressed with respect to the upper surface 604, and the slot 624 extends through the body to provide a fluid passageway through the body 602. In the illustrated embodiment, the ledges 622 are coplanar with the annular surface 614, but another depth for either one or both ledges 622 may be used. A blind chord portion 626 (FIG. 8), which does not include the slot 624, is formed at the ends of the channel 620. The slot 624 extends peripherally around a remainder of the rotor 510 that is on either side of the blind chord portion 626. Close to the chord ends of the channel 620, notches 628 are shown in the space formed within the channel 620 and the ledges 622.

As can be seen in FIG. 8, the bottom surface 606 surrounds the fill opening 616, which extends along a chord fill portion 630. A fill opening seat 632 extends around the fill opening 616. A bushing 633 also surrounds the drive opening 609. In an area of the bottom surface 606 that exists radially inwardly from the slot 624, the periphery 608, and the fill opening seat 632, a drain cavity 634 is formed as a depression in the bottom surface 606. The drain cavity 634 includes an offset surface 636 that is generally planar and extends into the body 602 and parallel to a plane of the bottom surface 606. The drain cavity 634 is generally shaped as a number "9" that has a generally circular, central portion 638 that surrounds the bushing 633, and a radial portion 640 that extends from the central portion 638 radially outward towards the periphery 608. The radial portion 640 spans a chord length 642 along the periphery 608.

Figure 9:
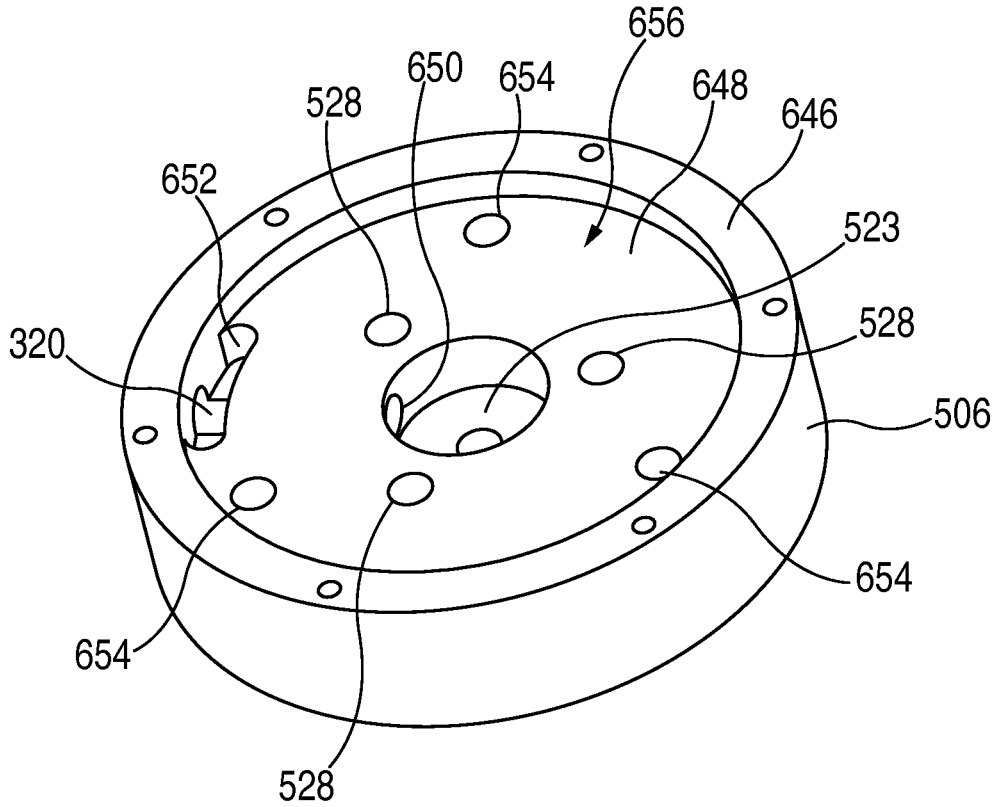
FIG. 9 is an outline view of a distributor head for a hydraulic distributor in accordance with the disclosure.

The various passages in the rotor 510 interact with passages formed in the flow plate 506. The flow plate 506 is shown removed from the pump 118 for sake of discussion and illustration of its various features in FIG. 9. In reference to FIG. 9, the flow plate 506 includes a plate body that is generally cylindrical and forms an outer wall 646 surrounding a flow direction portion 648. In reference to FIGS. 5 and 9 together, the flow plate 506 forms a central depression that collectively creates a drain passage 523 of various actuators of the pump, depending on the rotational position of the rotor 510. The drain passage 523, when acting as a drain during extension of the plungers, is connected to conduit 650 that leads to a sink 652 and also to the drain outlet 320. Three rod-end openings 654 extend through the flow plate 506 and through the tappet housing 504 to fluidly connect to an area below the tappets 512, which area is described in FIG. 5 as the variable volume 522. The flow plate 506 further forms the three head-end passages 528, each of which extends through the flow plate 506, as is also shown in cross section in FIG. 5. In the illustrated embodiment, the flow plate 506 forms a rotor depression 656 that rotatably accepts the rotor 510 when the pump is assembled, as shown in FIG. 5.

The operation of the pump 118 will now be described in more detail relative to the extension stroke and retraction stroke of each of a plurality of actuation elements, which in the illustrated embodiment includes three elements. Various fluid connections are made and interrupted by the rotational motion of the rotor 510 and, specifically, the changing orientation of the various passages formed therein, which operate as a hydraulic distributor such as the hydraulic distributor 308, as shown in FIG. 4. When a particular actuation element is undergoing an extension stroke, in which the piston extends to push the plunger via the pushrod to pump fluid, the remaining actuation elements may be undergoing a retraction stroke. The extension stroke occurs when high pressure hydraulic fluid present in the high pressure fluid inlet 316 (FIG. 5) is permitted to pass through the fill opening 616 of the rotor 510 (see FIG. 7) and into the head-end passage 528 (FIG. 5) to fill the extend volume 526 (FIG. 5) and push the tappet 512. At the same time, the rod-end passage 524 of the particular tappet 512, which fluidly communicates with the corresponding rod-end opening 654 (FIG. 9), is fluidly connected to the drain outlet 320 via the sink 652 (FIG. 9), the conduit 650 (FIG. 9), and the drain passage 523 along with the rod-end openings 654, the latter two being fluidly placed in connection by the rotation of the rotor via the drain cavity 634. In this condition, the radial portion 640 of the drain cavity 634, which rotates along with the rotor 510, aligns with the rod-end openings 654 and provides a fluid connection to the drain passage 523 while the chord length 642 (FIG. 8) is overlapping the rod-end openings 654.

As previously mentioned, while one of the actuation elements is extending, the remaining are retracting. During a retraction, the low pressure supply oil, which occupies the low pressure passage 530 (FIG. 5), is provided to the rod-end openings 654 of all actuation tappets that are not undergoing an extension stroke. The low pressure passage 530 is fluidly placed in connection with the rod-end openings 654 via the slot 624, and remains in contact therewith while the slot 624, and the channel 620, are aligned with the respective rod-end openings 654 as the rotor 510 rotates. At the same time, except for the actuation element that is extending, the head-end passages 528 (FIG. 9) of the remaining actuation elements are fluidly communicating with one another and also with the drain outlet 320 via the drain passage 523 (FIG. 9) via the central portion 638 of the drain cavity 634 of the rotor 510.

INDUSTRIAL APPLICABILITY

The particular embodiments described herein are not limiting and have broader applicability to the operation of various pumps having fewer or more that three pumping elements. It is also noted that the shape of the leading and/or trailing edges of the various openings described herein can be adjusted to shape the pressure application rate in the various volumes and cavities of the pump such that smooth and efficient operation can be accomplished. Also, while not specifically described herein, activation of the rotor 510 via the shaft 514 (FIG. 5) or by any other appropriate mechanism can be accomplished by any appropriate method such that the rotor rotates at a constant or a variable speed.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A pump, comprising:

a pump body;

a first pumping element and a second pumping element, each of the first and second pumping elements being independently actuatable to perform a pumping stroke that delivers a pumped amount of fluid at a pump discharge, wherein each of the first and second pumping elements includes a piston slidably disposed to reciprocate within a cylinder and defining a head-end volume and a rod-end volume on either side of the piston within the pump body;

a spring disposed to push the piston in a retracting direction in which the head-end volume decreases and the rod-end volume increases;

a first head-end passage formed in the pump body and fluidly connected with the head-end volume of the piston of the first pumping element, the first head-end passage forming a first head-end opening;

a second head-end passage formed in the pump body and fluidly connected with the head-end volume of the piston of the second pumping element, the second head-end passage forming a second head-end opening;

a first rod-end passage formed in the pump body and fluidly connected with the rod-end volume of the piston of the first pumping element, the first rod-end passage forming a first rod-end opening;

a second rod-end passage formed in the pump body and fluidly connected with the rod-end volume of the piston of the second pumping element, the second rod-end passage forming a second rod-end opening;

a high-pressure fluid inlet formed in the pump body, the high-pressure fluid inlet forming a high-pressure inlet opening;

a drain outlet formed in the pump body, the drain outlet forming a drain opening; and a rotor rotatably disposed within the pump body and being fluidly exposed to the high-pressure inlet opening on a first side and to the drain opening on a second side, the rotor forming a radially extending passage that is fluidly open to the drain opening, the rotor further forming a fill opening extending through the rotor between the first side and the second side, the fill opening being surrounded by a seat that fluidly isolates the fill opening from the drain opening;

wherein, as the rotor is rotating within the pump body, it assumes at least a first orientation and a second orientation with respect to the pump body; and wherein, in the first orientation, the fill opening is aligned with the first head-end passage to place the first head-end passage in fluid communication with the high-pressure inlet opening, and the radially extending passage overlaps the first rod-end passage to place the first rod-end passage in fluid communication with the drain opening and wherein, in the first orientation, the second head-end passage and the second rod-end passage are fluidly connected to one another and to the drain opening through the radially extending passage.

2. The pump of claim 1, wherein, in the first orientation, the second head-end passage is placed in fluid communication with the drain opening through the radially extending passage.

3. The pump of claim 1, wherein, in the second orientation, the fill opening is aligned with the second head-end passage to place the second head-end passage in fluid communication with the high-pressure inlet opening, and the radially extending passage overlaps the second rod-end passage to place the first rod-end passage in fluid communication with the drain opening.

4. The pump of claim 1, further comprising:

a low-pressure fluid inlet formed in the pump body, the low-pressure fluid inlet forming a low-pressure inlet opening that fluidly connects with an annular channel formed in the pump body; and a slot formed in the rotor, the slot being aligned with the annular channel and extending peripherally around the rotor along a chord length of a periphery of the rotor that does not include a chord length occupied by the radially extending passage, wherein the slot extends from the first side to the second side of the rotor.

5. The pump of claim 4, wherein, in the first orientation, the second head-end passage is placed in fluid communication with the drain opening through the radially extending passage and the second rod-end passage is placed in fluid communication with the low-pressure inlet opening through the slot.

6. The pump of claim 4, wherein, in the second orientation, the fill opening is aligned with the second head-end passage and is fluidly isolated from the first head-end passage to place the second head-end passage in fluid communication with the high-pressure inlet opening, and the radially extending passage overlaps the second rod-end passage to place the second rod-end passage in fluid communication with the drain opening.

7. The pump of claim 4, wherein, the second orientation, the first head-end passage is placed in fluid communication with the drain opening through the radially extending passage and the first rod-end passage is placed in fluid communication with the low-pressure inlet opening through the slot.

8. The pump of claim 1, further comprising:

a third pumping element that is independently actuatable from the first and second pumping elements, the third pumping element including the piston slidably disposed to reciprocate within a cylinder and defining the head-end volume and the rod-end volume on either side of the piston of the third pumping element within the pump body;

a third head-end passage formed in the pump body and fluidly connected with the head-end volume of the piston of the third pumping element, the third head-end passage forming a third head-end opening;

a third rod-end passage formed in the pump body and fluidly connected with the rod-end volume of the piston of the third pumping element, the third rod-end passage forming a third rod-end opening;

wherein, in the first orientation, the radially extending passage overlaps and fluidly interconnects the first rod-end passage, the second head-end passage, and the third head-end passage to place them in fluid communication with the drain opening.

9. The pump of claim 8, further comprising:

a low-pressure fluid inlet formed in the pump body, the low-pressure fluid inlet forming a low-pressure inlet opening that fluidly connects with an annular channel formed in the pump body; and a slot formed in the rotor, the slot being aligned with the annular channel and extending peripherally around the rotor along a chord length of a periphery of the rotor that does not include a chord length occupied by the radially extending passage, wherein the slot extends from the first side to the second side of the rotor.

10. The pump of claim 9, wherein, in the first orientation, the second head-end passage and the third head-end passage are placed in fluid communication with the drain opening through the radially extending passage, and the second rod-end passage and the third rod-end passage are placed in fluid communication with the low-pressure inlet opening through the slot.

11. The pump of claim 10, wherein an extension speed of the first pumping element is faster than a retraction speed of the second and third pumping elements when the rotor is in the first orientation.

12. The pump of claim 9, wherein, in the second orientation, the fill opening is aligned with the second head-end passage and is fluidly isolated from the first head-end passage and the third head-end passage to place the second head-end passage in fluid communication with the high-pressure inlet opening, and the radially extending passage overlaps the second rod-end passage, the first head-end passage, and the third head-end passage to place in fluid communication with one another and with the drain opening.

13. The pump of claim 9, wherein, the second orientation, the first head-end passage is placed in fluid communication with the drain opening through the radially extending passage and the first rod-end passage is placed in fluid communication with the low-pressure inlet opening through the slot.

14. The pump of claim 9, wherein, in a third orientation of the rotor with respect to the pump body, the radially extending passage overlaps and fluidly interconnects the third rod-end passage, the first head-end passage, and the second head-end passage to place them in fluid communication with the drain opening.

15. The pump of claim 14, wherein, in the third orientation, the first head-end passage and the second head-end passage are placed in fluid communication with the drain opening through the radially extending passage, and the first rod-end passage and the second rod-end passage are placed in fluid communication with the low-pressure inlet opening through the slot.

16. The pump of claim 1, wherein each of the first and second pumping elements includes a respective pushrod connected to a rod-end of the piston at one end of the pushrod, and to a plunger reciprocably disposed in a sleeve at another end of the pushrod such that a reciprocal motion of the piston is transferred to the plunger through the pushrod for pumping a fluid in a variable volume created between the plunger and the sleeve.

* * * * *